US009293006B2

(12) United States Patent
Ellis

(10) Patent No.: US 9,293,006 B2
(45) **Date of Patent: *Mar. 22, 2016**

(54) GAMING APPARATUS AND SYSTEMS WITH A BONUS SCHEME TRIGGERED BY A THRESHOLD FEATURED EVENT

(71) Applicant: Benjamin James Ellis, Wentworthville (AU)

(72) Inventor: Benjamin James Ellis, Wentworthville (AU)

(73) Assignee: Dynamite Services Pty Limited, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/848,207

(22) Filed: Sep. 8, 2015

(65) Prior Publication Data

US 2015/0379819 A1 Dec. 31, 2015

Related U.S. Application Data

(63) Continuation of application No. 12/893,095, filed on Sep. 29, 2010, now abandoned.

(30) Foreign Application Priority Data

Sep. 30, 2009 (AU) ..... 2009222486

(51) Int. Cl.
*G07F 17/32* (2006.01)

(52) U.S. Cl.
CPC ..... *G07F 17/3244* (2013.01); *G07F 17/3267* (2013.01)

(58) Field of Classification Search
None
See application file for complete search history.

(56) References Cited

U.S. PATENT DOCUMENTS

| | | | | |
|---|---|---|---|---|
| 6,168,523 | B1 | 1/2001 | Piechowiak et al. | |
| 6,234,897 | B1 | 5/2001 | Frohm et al. | |
| 6,270,409 | B1 | 8/2001 | Shuster | |
| 6,331,146 | B1 | 12/2001 | Miyamoto et al. | |
| 6,685,563 | B1 | 2/2004 | Meekins et al. | |
| 6,860,811 | B1 | 3/2005 | Wilkins | |
| 2003/0036423 | A1 | 2/2003 | Vancura | |
| 2003/0069056 | A1 | 4/2003 | Cormack et al. | |
| 2003/0148807 | A1 * | 8/2003 | Acres | G07F 17/32 463/26 |
| 2003/0216170 | A1 | 11/2003 | Walker et al. | |
| 2004/0072613 | A1 | 4/2004 | Visocnik | |
| 2005/0043092 | A1 | 2/2005 | Gauselmann | |
| 2005/0159211 | A1 | 7/2005 | Englman | |
| 2005/0215311 | A1 | 9/2005 | Hornik et al. | |
| 2006/0025196 | A1 * | 2/2006 | Webb | G07F 17/3244 463/16 |
| 2006/0035705 | A1 | 2/2006 | Jordan et al. | |
| 2006/0073874 | A1 * | 4/2006 | Cregan | G07F 17/3267 463/20 |
| 2006/0073887 | A1 | 4/2006 | Nguyen et al. | |

(Continued)

FOREIGN PATENT DOCUMENTS

| | | |
|---|---|---|
| AU | 2003236456 | 3/2004 |
| WO | WO-2005/037387 | 4/2005 |
| WO | WO-2009/062156 | 5/2009 |

*Primary Examiner* — Jason Yen
(74) *Attorney, Agent, or Firm* — Venable LLP; Henry J. Daley; George L. Howarah

(57) ABSTRACT

An embodiment of the present invention provides a bonus scheme associated with a gaming process that is a feature event. With reference to the embodiment illustrated in FIG. 3, a gaming process is conducted at Steps S3 to S5, the outcome of which determines a gaming process win value. At Step S7 the gaming process win value is compared to a threshold value and, if the gaming process win value is less than, or equal to the threshold value, a bonus prize is awarded to the player at Step S9.

12 Claims, 3 Drawing Sheets

(56) References Cited

U.S. PATENT DOCUMENTS

| | | | | |
|---|---|---|---|---|
| 2007/0060241 | A1 | 3/2007 | Low et al. | |
| 2008/0009338 | A1 | 1/2008 | Stewart | |
| 2008/0026816 | A1 | 1/2008 | Sammon et al. | |
| 2008/0045302 | A1 | 2/2008 | Low | |
| 2008/0064491 | A1* | 3/2008 | Taylor | G07F 17/3269 463/25 |
| 2008/0139296 | A1 | 6/2008 | Baerlocher et al. | |
| 2009/0011826 | A1 | 1/2009 | Acres | |
| 2009/0075728 | A1* | 3/2009 | Acres | G07F 17/32 463/25 |
| 2009/0111561 | A1 | 4/2009 | Dewaal et al. | |
| 2009/0124391 | A1 | 5/2009 | Nelson et al. | |
| 2009/0247267 | A1* | 10/2009 | Acres | G07F 17/32 463/20 |
| 2010/0087243 | A1 | 4/2010 | Saito et al. | |
| 2010/0093416 | A1 | 4/2010 | Seelig et al. | |
| 2010/0178975 | A1 | 7/2010 | Acres | |
| 2010/0298052 | A1 | 11/2010 | Parrottino | |

* cited by examiner

GAMING APPARATUS AND SYSTEMS WITH A BONUS SCHEME TRIGGERED BY A THRESHOLD FEATURED EVENT

INCORPORATION BY REFERENCE

The present application is a Continuation of U.S. patent application Ser. No. 12/893,095, filed Sep. 29, 2010, which claims priority to Australian Patent Application No. 2009222486 filed Sep. 30, 2009, the contents of which are hereby incorporated by reference.

FIELD OF THE INVENTION

The present invention relates to gaming apparatus and systems. It relates for example to electronic gaming machines and to networked gaming systems, such as Internet-based gaming systems.

BACKGROUND OF THE INVENTION

Gaming machines have been a popular form of entertainment for many years. This popularity has been enhanced with the advent of electronic gaming machines and computer-based gaming systems, such as are provided over the Internet.

Many different types of game are playable. They include for example standard slot-machine type games with spinning reels, poker machines, keno, bingo, blackjack, roulette, pachinko and the like.

A user will typically place a bet, press a button or pull a lever to begin a game, and will win or lose based upon the gaming machine's play algorithm and random number generator.

An aim of the present invention is to provide gaming apparatus having novel features for enhancing gameplay interest.

SUMMARY OF THE INVENTION

According to a first aspect of the invention there is provided a method of awarding a bonus prize to a player, the method including the steps of:

defining a threshold value;

conducting a gaming process so as to determine a gaming process win value, wherein the gaming process is a feature event, or part thereof; and comparing the gaming process win value to the threshold value and, if the gaming process win value is less than or equal to the threshold value, awarding the bonus prize to the player.

In an embodiment the threshold value is a constant predefined value that may preferably be zero. In another embodiment the threshold value is randomly determined.

An embodiment further includes the steps of:

defining a gaming participation threshold level;

determining a gaming participation level for the player; and making the award to the player of the bonus prize contingent upon the player's gaming participation level being equal to, or greater than, the gaming participation threshold level.

Preferably the method is triggered by a triggering bet. In an embodiment the threshold value is dependent upon a bet placed by the player, which may be the triggering bet. In an alternative embodiment the bet upon which the threshold value is dependent is a side bet placed at the commencement of the gaming process. Preferably the threshold value is equal to a first factor multiplied by the bet upon which the threshold value is dependent.

In an embodiment a value of the bonus prize is dependent upon a bet placed by the player. Preferably the value of the bonus prize is equal to a second factor multiplied by the bet upon which the value of the bonus prize is dependent. In this embodiment the value of the second factor is dependent upon the gaming process win value.

In an embodiment the value of the bonus prize is calculated in accordance with a predetermined or random calculation scheme. In one such embodiment the calculation scheme provides a substantially inverse relationship between the value of the bonus prize and the gaming process win value.

Preferably the bonus prize is any one or more of game credits, cash, a physical prize, extra free games, a jackpot and/or a re-play of the feature.

According to a second aspect of the invention there is provided computer executable code for instructing a computer to perform the method described above.

According to a third aspect of the invention there is provided a computing apparatus having a central processing unit, associated memory and storage devices, and input and output devices, the apparatus being configured to perform the method described above.

According to a fourth aspect of the invention there is provided gaming apparatus for awarding a bonus prize to a player, the apparatus including:

a component for defining a threshold value;

a component for conducting a gaming process so as to determine a gaming process win value, wherein the gaming process is a feature event, or part thereof; and a component for comparing the gaming process win value to the threshold value and, if the gaming process win value is less than or equal to the threshold value, awarding the bonus prize to the player.

According to another aspect of the invention there is provided a gaming system for awarding a bonus prize to a player, the system including:

a component for defining a threshold value;

a component for conducting a gaming process so as to determine a gaming process win value, wherein the gaming process is a feature event, or part thereof; and a component for comparing the gaming process win value to the threshold value and, if the gaming process win value is less than or equal to the threshold value, awarding the bonus prize to the player.

An embodiment of the system further includes a central control for running a gaming algorithm, and a plurality of remote clients in communication with the central control over a communications network, the remote clients including screens for the display of information to players.

Embodiments of the present invention may be applied to any suitable type of gaming system or platform. It can apply to stand-alone gaming apparatus, e.g. electronic gaming machines, such as video gaming machines, to gaming machines that are linked together, e.g. via a network such as an intranet, and/or to gaming systems provided through computing or other electronic devices, e.g. personal computers, PDAs, mobile telephones, digital televisions, and the like, e.g. over the Internet or other communications networks.

The present invention may be applied to gaming apparatus that plays any suitable game, e.g. slot-machine type games, poker, keno, blackjack, bingo, roulette, pachinko, or the like.

In some networked embodiments of the invention, the central control may conduct the games and manage the accounting and the like, and a number of remote terminals/clients merely provide the user input and display mechanisms. In other networked embodiments of the invention, the control of the games and various other features may be carried out at the remote terminals, or may be split between the central control and the remote terminals.

It should be noted that any of the features of any of the aspects mentioned above may be combined with any other features mentioned above, as appropriate.

Embodiments of the present invention will now be described, by way of example only, with reference to the accompanying drawings. It is to be understood that the particularity of the detailed description and the drawings does not supersede the generality of the preceding description of the invention.

BRIEF DESCRIPTION OF THE ACCOMPANYING DRAWINGS

DETAILED DESCRIPTION OF PREFERRED EMBODIMENTS OF THE INVENTION

Figure 1:
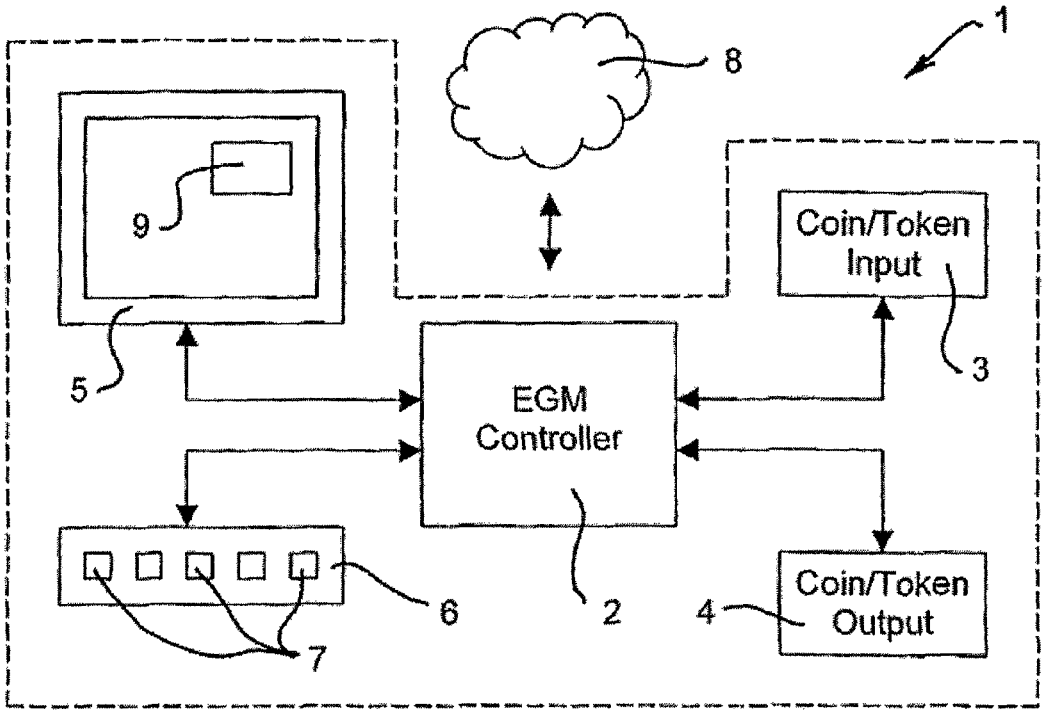
FIG. 1 is a block diagram of gaming apparatus according to one embodiment of the present invention.

Referring to FIG. 1, gaming apparatus, which in this case takes the form of an electronic gaming machine (EGM) 1, includes various standard components, such as a controller 2 for controlling the operation of the EGM 1 and the games run on it, a note/coin/token input 3 for receiving bets, a note/coin/token output 4 for paying out winnings, a display 5 for displaying game screens, and player input means 6 for allowing user interaction, which may include e.g. buttons 7 and which may e.g. be provided as part of the display 5 in a touch-screen type manner.

The EGM 1 may be a stand-alone machine. It may also be networked with other EGMs and/or a control centre via a suitable communications network 8, such as a LAN and/or WAN, in order to play networked (e.g. intranet or Internet) games, such as a linked jackpot.

Figure 2:
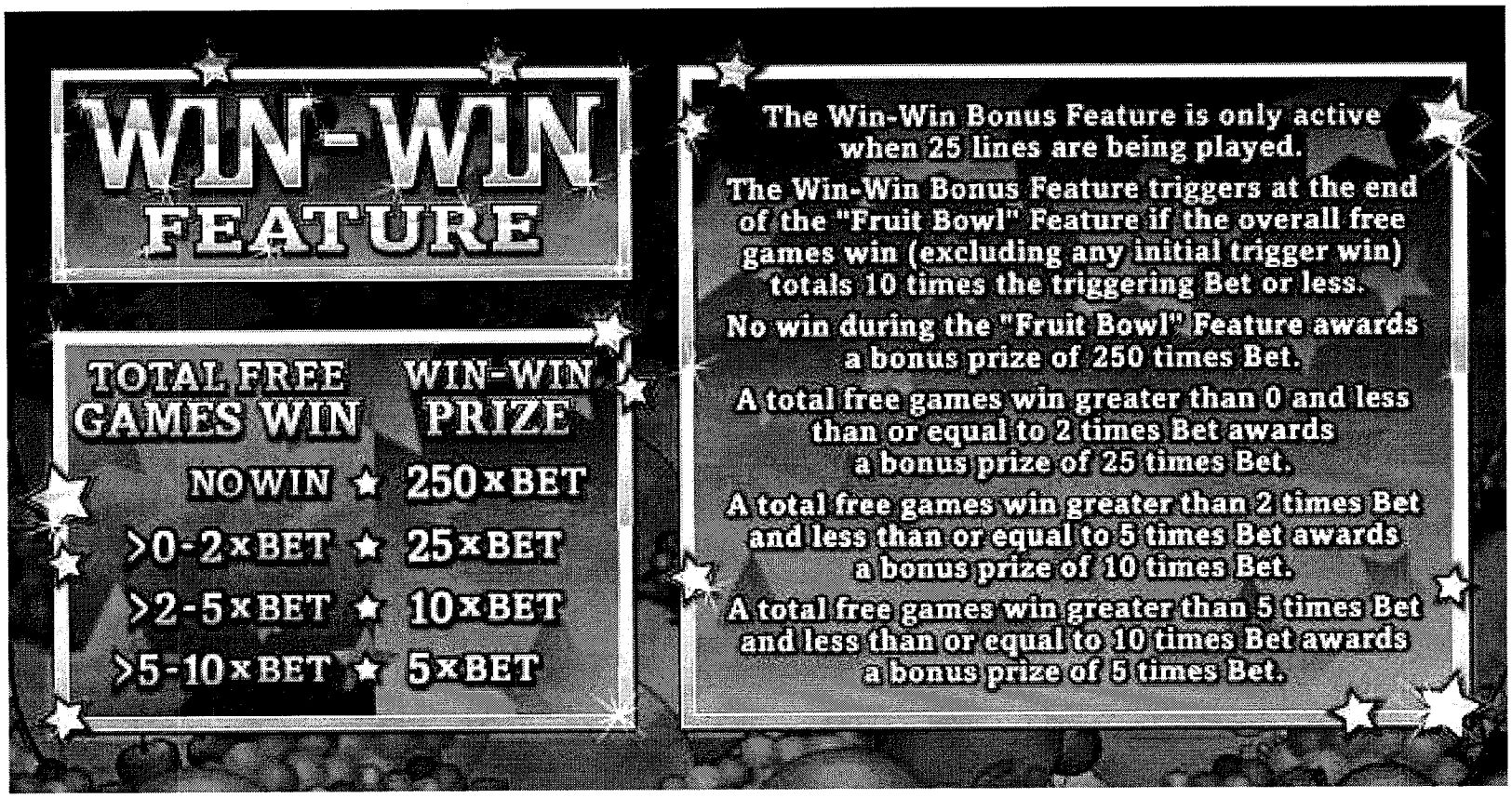
FIG. 2 is a generic gaming display screen shot according to an embodiment of the present invention.

In use, the EGM 1 will display an initial gaming screen on the display 5. A player will insert bank notes, coins and/or tokens into the EGM input 3, and will press a button 7 to initiate play of the main game provided by the EGM. How matters then proceed will depend on the type of main game being played. For example, FIG. 2 illustrates a game screen from a slot machine-type game, in which the EGM 1 displays virtual reels 10 of symbols 11, and spins and stops these reels 10 in various win and lose symbol combinations on one or more paylines 12 in accordance with a stored gaming algorithm and random number generator. In an alternative embodiment (not illustrated) the main game is a poker-type game, in which a player will receive a number of cards with which to play for a winning hand. It will be appreciated that other types of main games may be provided, such as keno, blackjack, bingo, roulette, pachinko, or the like. For the purposes of this detailed description, the main focus shall be upon an embodiment providing a slot machine-type main game.

The player may interact via the buttons 7, so as e.g. to spin or hold reels and otherwise play the main game. A common element will be win events, e.g. particular symbol combinations that pay out a prize or jackpot.

Also, in order to increase interest, the main game is capable of providing feature events that consist of one or more feature games, which may or may not relate directly to the main game being played, and that generally provide a prize of some sort. These feature events may include for example one or more free games, a re-spin (similar to a free game but with one or more reels held on a slot device), and the chance to play for higher winnings or the like. They may be e.g. luck or skills based. They may be provided as "second screen" features that display on a new screen, and may be extraneous to the main game.

Another way of adding gaming interest is for a main game or a feature event to include one or more wild symbols that can represent more than one type of symbol or card, and so can increase the chances of achieving a winning combination or the like. Similarly, for embodiments in which the main game is a card game, wild cards may be provided.

These win and feature events can be arranged to occur due to the usual operation of the main game randomly or under a particular set of circumstances, e.g. under a set symbol or card combination. They may also occur due to an accumulation of circumstances across a number of games, and may occur due to the condition of a device supplemental to the EGM 1 itself, e.g. they may relate to jackpot wins in linked jackpot systems comprising a plurality of EGMs under a central control.

FIG. 1 illustrates an essentially stand-alone electronic gaming machine (albeit with the potential for networked connectivity). However, another embodiment provides a gaming system including networked computing apparatus having a central processing unit disposed at a central control computer. A plurality of remote clients is in communication with the central control computer over a communications network such as a local area network and/or a wide area network. Each of the remote clients has at least one screen for the display of information to a player and input means allowing for player interaction with the central control.

The central control computer has access to associated memory and storage devices. The central control computer also has access to computer executable code for instructing the central control computer to run the gaming algorithm that performs the embodiment of the inventive method. In one embodiment the computer executable code is in the form of software and associated data, which are stored upon a computer-readable medium in the form of one or more compact disks. Alternative embodiments make use of other forms of digital storage media, such as Digital Versatile Discs (DVD's), hard drives, flash memory, Erasable Programmable Read-Only Memory EPROM, and the like. Alternatively, the software and its associated data may be stored as one or more downloadable or remotely executable files that are accessible via a computer communications network such as the internet.

The embodiment of the present invention provides a bonus scheme associated with a gaming process that is a feature event. At appropriate times during play of the main game or the feature event, the player may use the input means 6 to indicate that the player wishes to review the rules of the bonus scheme, which is referred to in this embodiment as the WIN-WIN FEATURE. This results in the screen shot shown in FIG. 2 being presented to the player on display 5.

Figure 3:
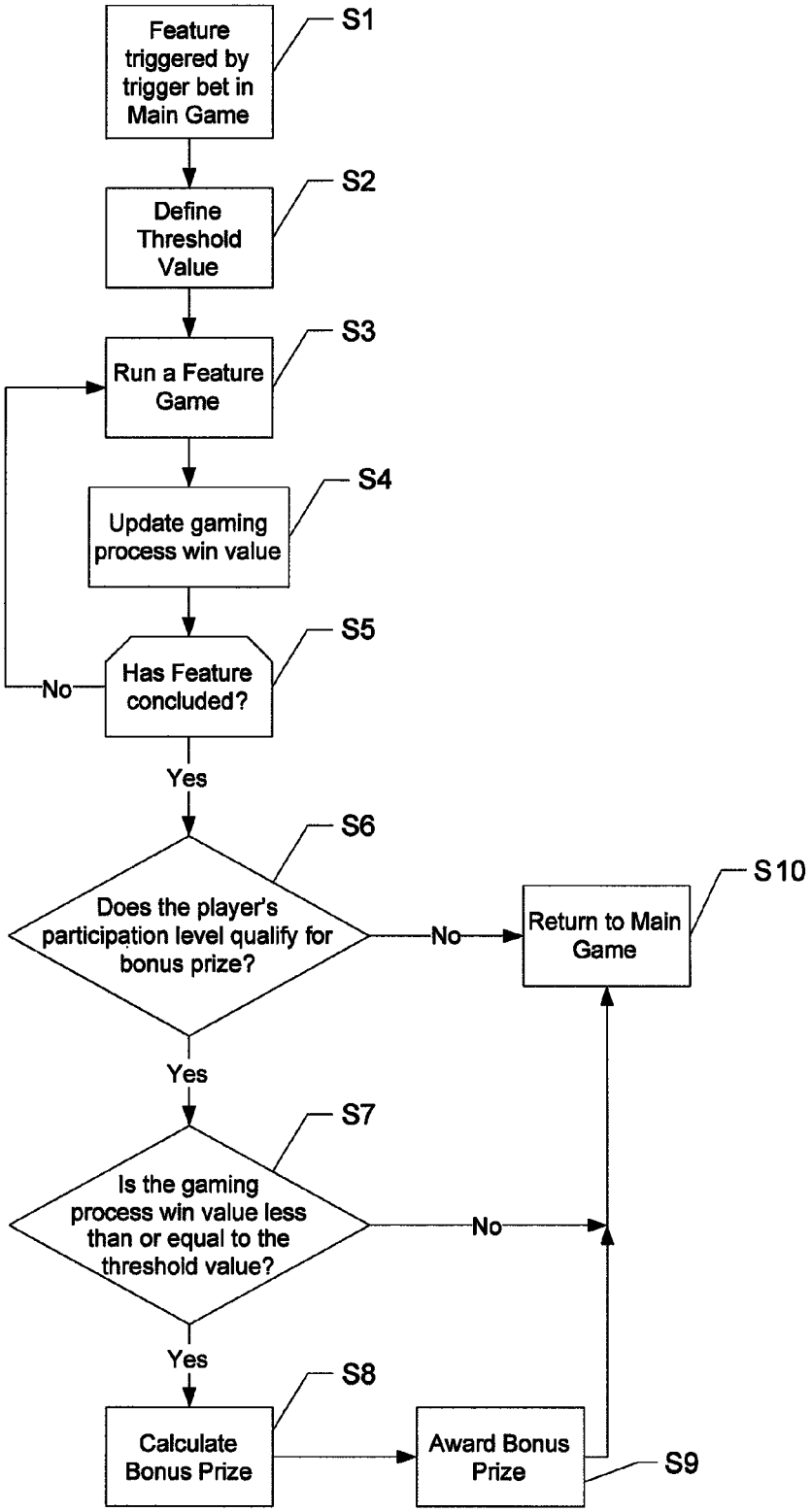
FIG. 3 is a flow diagram of a gaming control process in accordance with an embodiment of the present invention.

In accordance with one embodiment of the present invention, the EGM 1 includes within the gaming algorithm components for taking the various method steps that are depicted in flowchart form in FIG. 3. This flowchart assumes that the main game is being played by the player and at some point a feature event is triggered by a bet placed on the main game by the player. This is represented by Step S1 on the flow chart. At this step the amount of the triggering bet, and the number of lines on which the trigger bet was placed, are stored at a predefined memory address in random access memory that is accessible to the processor in the EGM controller 2. For the sake of a running example, we shall assume that the amount of the trigger bet was $2.00 (or the equivalent in credits) and that this bet was placed on all 25 lines of the main slot machine game.

At Step S2 the processor defines the threshold value. In this embodiment the threshold value is equal to the trigger bet value multiplied by a first factor of ten. Hence, in the running example, the threshold value is $20.00 (i.e. $2.00 multiplied by 10). The threshold value is stored at a predefined memory address in random access memory that is accessible to the processor. At this step the processor also sets a variable known as the gaming process win value to zero. This variable is stored at another memory address.

At Step S3 the processor commences running of a gaming process in the form of the feature event, which consists of a number of feature games. Each of these games may, or may not, result in the award of monetary prizes (or the equivalent in credits) to the player. After each game, at Step S4, the processor adds the amount won in the preceding game to the gaming process win value so as to keep track of the total amount won by the player in the feature games. For the running example we shall assume that the total amount won by the player by the conclusion of the feature games is $3.00 (or the equivalent in credits).

At Step S5 the loop limiter determines whether the required number of feature games has been played. If not, the processor loops back to Step S3. If the required number of feature games has been played the processor moves onto Step S6. This step makes the award of the bonus prize to the player contingent upon the player's gaming participation level. In the current embodiment, the gaming participation threshold level is defined with regard to the number of lines of the bet on the main slot machine game that triggered the feature event. That is, the triggering bet must have been placed on all 25 lines for the play to potentially qualify for a bonus prize. Hence, the processor accesses the memory address at which the number of lines of the trigger bet is stored in order to determine a gaming participation level for the player. The processor then compares this value to the predefined gaming participation threshold level of 25. If the two values are equal, then the player qualifies for a possible award of a bonus prize and the processor moves onto Step S7. If the two values are not equal, then the processor moves to Step S10, which consists of returning to the main game. In the running example the trigger bet was on all 25 lines and hence the player qualifies for a chance at being awarded the bonus prize.

At Step S7 the processor accesses the memory addresses at which the gaming process win value and the threshold value were stored. These two values are compared and, if the gaming process win value is greater than the threshold value, the player is not awarded the bonus prize and the processor moves to Step S10. If the gaming process win value is less than, or equal to, the threshold value, the processor moves to Step S8. In the running example, the gaming process win value is $3.00, which is less than the threshold value of $20.00. Hence, a bonus prize must be awarded to the player.

At Step S8 the processor calculates the amount of the bonus prize. Firstly the processor accesses the memory addresses at which the gaming process win value and the trigger bet amount were stored. The processor then determines in which range the gaming process win value falls with reference to some predetermined ranges. The resultant range determines a second factor in accordance with the following look up table:

| Gaming Process Win Value Range | Second Factor |
|---|---|
| Zero | 250 |
| Greater than zero to 2 times the trigger bet amount | 25 |
| Greater than 2 times the trigger bet amount to 5 times the trigger bet amount | 10 |
| Greater than 5 times the trigger bet amount to 10 times the trigger bet amount | 5 |

With reference to the running example, in which the trigger bet amount is $2.00, this look up table is as follows:

| Gaming Process Win Value Range | Second Factor |
|---|---|
| Zero | 250 |
| Greater than zero to $4.00 | 25 |
| Greater than $4.00 to $10.00 | 10 |
| Greater than $10.00 to $20.00 | 5 |

In the running example the gaming process win value was $3.00, which falls within the range of "Greater than zero to $4.00". Hence, for the running example the second factor is 25. To calculate the amount of the bonus prize, the processor multiplies the trigger bet amount by the second factor. Hence, in the running example, the amount of the bonus prize is $50.00.

It will be appreciated from the above tables that as the win value range increases, the second factor decreases. Hence, this scheme for calculation of the amount of the bonus prize provides a substantially inverse relationship between the value of the bonus prize and the gaming process win value, albeit in a staggered and approximate manner as opposed to a mathematically perfect inverse relationship. In other embodiments the determination of the value of the bonus prize at Step S8 is via a predetermined or random calculation scheme.

At Step S9 the bonus prize is awarded to the player. This may be in the form of is any one or more of game credits, cash, a physical prize, extra free games, a jackpot and/or a re-play of the feature, provided that the total value of the bonus prize is equal to the amount calculated in Step S8. Once the prize has been awarded the processor moves onto Step S10 and returns to the main game.

In the above embodiment the threshold value was determined at Step 2 by multiplying the trigger bet by a first factor of ten. However, in another embodiment the threshold value has a predetermined constant value. For example, if the threshold value is set to zero, then the bonus prize is only awardable if the player wins nothing in the feature event. In other words, if the threshold value is zero then the gaming process win value must also be zero in order to satisfy the test at Step S7. In a further embodiment the threshold value is dependent upon a side bet placed at the commencement of the feature event. Such a side bet may be a secondary bet that is optional or compulsory.

In yet another embodiment, the threshold value is randomly determined at Step S2 from amongst a range of possible values. As used in this document, including in the claims, the terms "random", "randomly", "randomized", and the like, are to be construed as connoting either a purely random process or a "pseudo-random" process. An example of a pseudo-random process includes the determination by a computer processor of a pseudo-random number in response to an output of a digital clock.

In the embodiment shown in FIG. 3 the routine to determine whether to award the bonus prize (i.e. Steps S6 and S7) is performed after the feature event has concluded and the gaming process win value that is used in the routine is the sum of the winnings from all of the feature games in the feature event. However in an alternative embodiment the routine is conducted at predefined points, or randomly determined points, throughout the feature event. In this embodiment the gaming process win value that is used in the routine is the sum of the winnings from only the relevant part of the feature event. For example, the routine to determine whether to award the bonus prize may be performed at the conclusion of each pair of feature games during the feature event. In this case the gaming process win value that is used in the routine is the sum of the player's winnings solely from the preceding pair of feature games. In this alternative embodiment, the player may be given more than one chance to win a bonus prize for each feature event that is triggered.

It is to be understood that various alterations, additions and/or modifications may be made to the parts previously described without departing from the ambit of the present invention, and that, in the light of the above teachings, the present invention may be implemented in software, firmware and/or hardware in a variety of manners as would be understood by a person skilled in the art.

The claims defining the invention are as follows:

1. Gaming apparatus for awarding a bonus prize to a player, the apparatus including:

a component for defining a threshold value;

a component for receiving at least one of a coin, token, game credit and bank note to start a gaming process;

a component for conducting the gaming process so as to determine a cumulative win value for the gaming process, wherein the gaming process is a feature event, or part thereof, which is triggerable through play of a main game and which and wherein the gaming process includes an awarding of at least two feature games; and a component for comparing the cumulative win value to the threshold value and, if the cumulative win value is less than or equal to the threshold value, awarding the bonus prize to the player and wherein a value of the bonus prize is determined based, at least in part, on the cumulative win value and a value of a wager placed on the main game which triggered the feature event.

2. A gaming apparatus according to claim 1, wherein the threshold value is a constant predefined value.

3. A gaming apparatus according to claim 2, wherein the threshold value is zero.

4. A gaming apparatus according claim 1, wherein the threshold value is randomly determined by the processor.

5. A gaming apparatus according to claim 1, further comprising a component for determining a player participation level associated with play of the main game such that the awarding of the bonus prize is additionally dependent on the player participation level meeting a predefined threshold.

6. A gaming apparatus according to claim 1, wherein the threshold value is dependent upon a bet placed by the player.

7. A gaming apparatus according to claim 6, wherein the threshold value is dependent upon a triggering bet for the feature event.

8. A gaming apparatus according to claim 6, wherein the bet upon which the threshold value is dependent is a side bet placed at the commencement of the gaming process.

9. A gaming apparatus according to claim 6, wherein the threshold value is equal to a first factor multiplied by the bet upon which the threshold value is dependent.

10. A gaming apparatus according to claim 1, wherein the value of the bonus prize is equal to a second factor multiplied by the bet upon which the value of the bonus prize is dependent.

11. A gaming apparatus according to claim 10, wherein the value of the second factor is dependent upon the gaming process cumulative win value.

12. A gaming apparatus according to claim 2, wherein the bonus prize is any one or more of: game credits; cash; a physical prize; extra free games; a jackpot or a re-play of the feature event.

* * * * *